US008866574B2

(12) United States Patent
Kaneko et al.

(10) Patent No.: US 8,866,574 B2
(45) Date of Patent: Oct. 21, 2014

(54) RARE EARTH MAGNET AND PROCESS FOR PRODUCING SAME

(75) Inventors: Yuji Kaneko, Nagoya (JP); Yukio Takada, Nisshin (JP); Motoki Hiraoka, Toyota (JP); Keiu Kanada, Miyoshi (JP)

(73) Assignees: Kabushiki Kaisha Toyota Chuo Kenkyusho, Nagakute-shi (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 14/000,537

(22) PCT Filed: Mar. 8, 2012

(86) PCT No.: PCT/JP2012/056017
§ 371 (c)(1),
(2), (4) Date: Aug. 20, 2013

(87) PCT Pub. No.: WO2012/121351
PCT Pub. Date: Sep. 13, 2012

(65) Prior Publication Data

US 2013/0335180 A1 Dec. 19, 2013

(30) Foreign Application Priority Data

Mar. 10, 2011 (JP) ..... 2011-052376

(51) Int. Cl.

| | |
|---|---|
| ***H01F 7/02*** | (2006.01) |
| ***B05D 5/12*** | (2006.01) |
| ***H01F 1/057*** | (2006.01) |
| ***C23C 10/28*** | (2006.01) |
| ***H01F 41/02*** | (2006.01) |
| *B22F 3/24* | (2006.01) |

(52) U.S. Cl.
CPC ..... *H01F 7/02* (2013.01); *B22F 2003/241* (2013.01); *B22F 2003/248* (2013.01); *H01F 1/0577* (2013.01); *C23C 10/28* (2013.01); *B22F 3/24* (2013.01); *H01F 41/0293* (2013.01)
USPC ..... 335/302; 427/127

(58) Field of Classification Search
CPC ..... H01F 1/0577; H01F 7/02; H01F 41/0293; H01F 41/20; H01F 10/126
USPC ..... 335/302; 427/127
See application file for complete search history.

(56) References Cited

U.S. PATENT DOCUMENTS 5,147,447 A * 9/1992 Takeshita et al. ..... 75/246

(Continued)

FOREIGN PATENT DOCUMENTS

| | | |
|---|---|---|
| JP | A-2008-177332 | 7/2008 |
| JP | A-2009-043776 | 2/2009 |

(Continued)

OTHER PUBLICATIONS

Kaneko et al., U.S. Appl. No. 13/384,901, filed Jan. 19, 2012.

*Primary Examiner* — Bernard Rojas
(74) *Attorney, Agent, or Firm* — Oliff PLC

(57) ABSTRACT

A process for producing a rare earth magnet comprises: an adhesion step of causing a diffusion element capable of diffusing inwardly to adhere to the surface part of a magnet material comprising a compact or sintered body of rare earth alloy particles; and an evaporation step of heating the magnet material in vacuum to evaporate at least a portion of the diffusion element having been retained on or in the surface part of the magnet material.

1 Claim, 13 Drawing Sheets

(56) References Cited

U.S. PATENT DOCUMENTS

| | | | | |
|---|---|---|---|---|
| 2007/0034299 | A1* | 2/2007 | Machida et al. | 148/105 |
| 2008/0286595 | A1 | 11/2008 | Yoshimura et al. | |
| 2009/0020193 | A1 | 1/2009 | Ohta et al. | |
| 2010/0159129 | A1 | 6/2010 | Nagata et al. | |
| 2013/0293328 | A1* | 11/2013 | Kuniyoshi | 335/302 |

FOREIGN PATENT DOCUMENTS

| | | | |
|---|---|---|---|
| JP | A-2009-135393 | | 6/2009 |
| JP | A-2009-200179 | | 9/2009 |
| WO | WO 2006/100968 | A1 | 9/2006 |
| WO | WO 2006/112403 | A1 | 10/2006 |
| WO | WO 2007/102391 | A1 | 9/2007 |

* cited by examiner

ONLY VAPOR DEPOSITION STEP (HEAT PATTERN 3)

RARE EARTH MAGNET AND PROCESS FOR PRODUCING SAME

TECHNICAL FIELD

The present invention relates to a rare earth magnet which can obtain high magnetic characteristics (especially high coercivity) while reducing the amount of a diffusion element such as dysprosium (Dy) to be used and also to a process for producing the same.

BACKGROUND ART

Rare earth magnets (especially permanent magnets) represented by Nd—Fe—B-based magnets exhibit considerably high magnetic characteristics. The use of such rare earth magnets allows electromagnetic devices and electric motors to be reduced in size, enhanced in output power, and implemented with high density, and also enables reduction of environmental burdens etc, so the application of rare earth magnets is being investigated in various fields.

In order to achieve the above, however, it is required for rare earth magnets to stably exhibit such excellent magnetic characteristics for a long period of time even under severe environments. To this end, research and development are actively conducted to enhance the coercivity effective to heat resistance property (resistance for demagnetization) and the like while maintaining or further improving the high residual magnetic flux density of rare earth magnets. One of the most effective methods therefor is to cause diffusion elements, such as dysprosium (Dy) and terbium (Tb), which are rare earth elements having large anisotropy magnetic fields (Ha), to be diffused to grain boundaries and the like of crystals as main phases (e.g. $Nd_2Fe_{14}B$-type crystals). This allows the improvement of magnetocrystalline anisotropy and the suppression of nucleation of reverse magnetic domains while suppressing the substitution of Dy and the like in those crystal grains, and also allows the improvement of coercivity while suppressing the deterioration of residual magnetic flux density.

Meanwhile, there are various methods for such diffusion. For example, powder mixing method is known in which diffusion powder that includes diffusion elements is mixed with magnet powder comprising raw material alloy (rare earth magnet alloy) and the obtained powder mixture is formed into a compact such as to be sintered thereby performing the above diffusion treatment. In addition, adhesion method is also known in which diffusion powder or the like is caused to adhere to the surface of a magnet material and heat treatment is then performed for diffusion treatment. Furthermore, vapor deposition method (vaporization method) is proposed in which, to effectively improve the coercivity while suppressing the amount of Dy and the like as rare elements to be used, diffusion elements are vapor deposited on a magnet material comprising magnet powder thereby to be diffused inwardly. This vapor deposition method is the recent mainstream, details of which are described in the patent literature below, for example.

CITATION LIST

Patent Literature

[PTL 1]
International Publication No. WO2006/100968
[PTL 2]
International Publication No. WO2007/102391 (Japanese Unexamined Patent Application Publication No. 2008-263223, Japanese Unexamined Patent Application Publication No. 2009-124150)

[PTL 3]
Japanese Unexamined Patent Application Publication No. 2008-177332
[PTL 4]
Japanese Unexamined Patent Application Publication No. 2009-43776
[PTL 5]
Japanese Unexamined Patent Application Publication No. 2009-200179

SUMMARY OF INVENTION

Technical Problem

The contents described in the above patent literature are all basically such that a diffusion material as vapor source for diffusion elements is heated with the magnet material under the same condition and the diffusion elements are vapor deposited on the magnet material surface and diffused therefrom (refer to FIG. 9B). In this case, however, the vapor deposition and the diffusion are integrally performed, so that the completion of the vapor deposition treatment means the end of the diffusion treatment.

As a consequence, such a method comes to an end where the diffusion elements having been vapor deposited are retained with high density in the vicinity of the surface of the magnet material thereby not being diffused inwardly, which would result in a situation that the rare Dy or the like could not be effectively utilized for the improvement in coercivity of rare earth magnets.

The present invention has been created in view of such circumstances. That is, objects of the present invention include providing a rare earth magnet which can more efficiently enhance the coercivity while suppressing the amount of a diffusion element such as rare Dy to be used and also providing a process for producing the same.

Solution to Problem

As a result of intensive studies to solve such problems and repeating trial and error, the present inventors have conceived of evaporating diffusion elements (such as Dy), which are retained in the vicinity of the surface of a magnet material and not diffused inwardly, from that surface. In fact, a rare earth magnet has been successfully obtained which exhibits the coercivity comparable with or larger than that of conventional ones while reducing the amount of diffusion elements contained in the magnet material. Developing this achievement, the present invention has been accomplished as will be described hereinafter.

<<Process for Producing Rare Earth Magnet>>

(1) The process for producing a rare earth magnet according to the present invention is characterized by comprising: an adhesion step of causing a diffusion element capable of diffusing inwardly to adhere to a surface part of a magnet material comprising a compact or sintered body of rare earth alloy particles; and an evaporation step of heating the magnet material in vacuum to evaporate at least a portion of the diffusion element having been retained on or in the surface part of the magnet material.

(2) According to the production process of the present invention, the evaporation step can evaporate excessive diffusion elements (such as Dy) that have been unduly concentrated in the vicinity of the surface of the magnet material in the adhesion step. This allows to mitigate or eliminate the concentration gradient of the diffusion elements which is caused between the surface part of the magnet material and the inner part thereof, and also enables the diffusion elements to be further diffused inwardly. In such a manner, a rare earth magnet having high magnetic characteristics (especially high coercivity) can be obtained in which the diffusion elements are deeply diffused inside the magnet material while reducing the amount of rare diffusion elements to be used.

Note that the diffusion elements evaporated in the evaporation step from the surface of the magnet material can be trapped or recovered for reuse such as by cold trap provided at vacuum exhaust outlet and the like. Therefore, on the whole of the production process according to the present invention, rare diffusion elements are effectively utilized without being wasted in any way, and a rare earth magnet having high magnetic characteristics (especially high coercivity) can thus be obtained.

Moreover, according to the diffusion treatment comprising the adhesion step and the evaporation step as in the present invention, the treating time can be significantly reduced compared with that of the conventional diffusion treatment. This is because, different from the conventional treatment, it is not necessarily required to slowly perform vapor deposition or the like of the diffusing elements to the surface of the magnet material during a long period of time in accordance with the diffusion rate of the diffusion elements therein. In other words, that is because, according to the production process of the present invention, even in the case where the adhesion step causes the diffusion elements to temporarily, or during a short period of time, adhere to the surface of the magnet material, the subsequent evaporation step allows the diffusion elements to be sufficiently diffused into the inner part of the magnet material while removing or recovering the excessive diffusion elements on or in the surface part.

More specifically, according to the production process of the present invention, a rare earth magnet, in which the amount of diffusing elements such as Dy is suppressed to one-tenth to half that of conventional one, can be obtained through diffusion treatment of a few hours while exhibiting the coercivity comparable with or larger than that of conventional rare earth magnets treated with diffusion treatment.

<<Rare Earth Magnet>>

(1) The present invention can be perceived not only as the above production process but as a rare earth magnet obtained by the production process. Further, this rare earth magnet is obviously different from the conventional rare earth magnets in the correlation between the amount of the diffusion elements and the coercivity. That is, the rare earth magnet according to the present invention falls within an entirely novel region in terms of the amount of the diffusion elements and the coercivity. In this respect, the present invention can also be perceived as the rare earth magnet below in itself independently from the above production process.

(2) That is to say, the present invention may be a rare earth magnet comprising: a magnet material comprising a compact or sintered body of rare earth alloy particles; and a diffusion element diffused from a surface part of the magnet material to an inner part, wherein the rare earth magnet is characterized in that the amount d (mass %) of the diffusion element when the whole of the rare earth magnet is 100 mass %, the coercivity Ht (kOe=79.58 kA/m) of the whole of the rare earth magnet, the coercivity Hs (kOe) of the surface part of the rare earth magnet, and the coercivity Hi (kOe) of the inner part of the rare earth magnet satisfy relational expressions below:

$$Ht-(2d+11)\geq 3.5(\text{kOe}) \quad \text{(Mathematical Expression 1) and}$$

$$Hi/Hs\geq 0.8 \quad \text{(Mathematical Expression 2).}$$

The term "surface part" as used herein refers to a part where the depth from the outermost surface (diffusion surface) of the rare earth magnet to which the diffusion element adhere is 0% to 15% the height (overall height) of the whole of the rare earth magnet. The "inner part" also refers to a part where the depth from the outermost surface is 51% to 66% the overall height. The "coercivity Hs of the surface part" is a value obtained by measuring a thin-plate-like sample (flake sample) which corresponds to the above surface part and which is obtained by slicing a rare earth magnet as a given material, using a Pulsed High Field Magnetometer (available from TOEI INDUSTRY CO., LTD). The "coercivity Hi of the inner part" is also a value obtained in the same manner by measuring a flake sample which corresponds to the above inner part and which is obtained by slicing the rare earth magnet.

Note that the rare earth magnet satisfying Mathematical Expressions 1 and 2 is not limited to one obtained by the above production process, but is of course preferred to be one obtained by the above production process. Hereinafter, the meaning of Mathematical Expressions 1 and 2 will be described by exemplifying the case of Dy as a typical example of the diffusion element.

The coercivity of a rare earth magnet (especially NdFeB-based sintered magnet) without diffusion treatment is about 11 kOe in general. It is known that, if rare earth alloy particles constituting the rare earth magnet contain Dy, then the coercivity of the rare earth magnet generally increases about 2 kOe per one mass % of Dy. Therefore, the straight line represented by Ht−(2d+11)=0 using the left-hand member of Mathematical Expression 1 is to be a baseline when contemplating the degree of increase in the coercivity of a rare earth magnet. Consequently, Mathematical Expression 1 means that the coercivity of the rare earth magnet according to the present invention is higher than the baseline by 3.5 kOe or more. There conventionally exists almost no rare earth magnet which exhibits considerably high coercivity in the correlation with the amount of Dy.

Mathematical Expression 2 means that the rare earth magnet according to the present invention is such that the coercivity difference is significantly small between the surface part (Hs) and the inner part (Hi). More specifically, Mathematical Expression 2 means that the Dy concentration gradient is very small or moderate toward the inner part from the surface part because Dy is not unduly retained on or in the surface part of the rare earth magnet and is diffused into the inner part. There also conventionally exists almost no rare earth magnet in which the coercivity difference is significantly small between the surface part and the inner part with such an extent.

Moreover, as far as a rare earth magnet diffused with the diffusion element from the surface of the magnet material, there never exists any rare earth magnet which satisfies both Mathematical Expressions 1 and 2. Therefore, a rare earth magnet falling within the region defined by both mathematical expressions is provided for the first time by the present invention.

In the present invention, the left-hand member of Mathematical Expression 1 may also be 4 kOe or more, 4.5 kOe or more, or 5 kOe or more. It is preferred that this left-hand member of Mathematical Expression 1 is large as much as possible, so the upper limit thereof cannot be provided and may not be required. Suffice it to say that the left-hand member of Mathematical Expression 1 may also be 8 kOe or less, 7 kOe or less, or 6 kOe or less. The left-hand member of Mathematical Expression 2 may also be 0.82 or more, or 0.84 or more. It is also preferred that this left-hand member of Mathematical Expression 2 is large as much as possible, so the upper limit thereof may not be required. Suffice it to say that the left-hand member of Mathematical Expression 2 may also be 1 or less, 0.95 or less, or 0.9 or less.

(3) Examples of the rare earth magnet according to the present invention include a rare earth magnet raw material and a rare earth magnet member, and the form thereof is not limited. For example, the rare earth magnet may be in block-like, circular, or thin film-like form. The rare earth magnet according to the present invention is preferably an anisotropic rare earth magnet having high magnetic characteristics, but may also be an isotropic rare earth magnet.

Note that the magnet material is a material which is to be subjected to diffusion treatment, and may be a compact comprising rare earth alloy particles or a sintered body obtained by sintering the compact. Furthermore, the magnet material may be a final product, an intermediate material, or a bulk material.

Diffusion of the diffusion element as referred to herein mainly means diffusion (surface diffusion or grain boundary diffusion) to surfaces or grain boundaries of rare earth alloy particles (magnet powder particles) or crystals (main phases) constituting the particles. Note, however, that diffusion into crystal grains (lattice or volume diffusion) may also be included therein. Note also that the "grain boundary" and "interface" as simply referred to herein include those of rare earth alloy particles as well as those of crystal grains that constitute the rare earth alloy particles.

<<Others>>

(1) Examples of rare earth element (R) as referred to herein include scandium (Sc), yttrium (Y), and lanthanoid. Examples of lanthanoid include lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), lutetium (Lu).

(2) The "rare earth alloy" as referred to herein comprises one or more types of primary rare earth elements (referred hereinafter to as "Rm") of rare earth elements, boron (B), remaining transition metal elements (TM: mainly Fe), and inevitable impurities and/or modifying elements. The Rm comprises one or more types of the above R, among which Nd and/or Pr are representative.

Examples of modifying elements include at least one type selected from cobalt (Co) and lanthanum (La), which improve heat resistance of a rare earth magnet, and gallium (Ga), niobium (Nb), aluminum (Al), silicon (Si), titanium (Ti), vanadium (V), chromium (Cr), manganese (Mn), nickel (Ni), copper (Cu), germanium (Ge), zirconium (Zr), molybdenum (Mo), indium (In), tin (Sn), hafnium (Hf), tantalum (Ta), tungsten (W), and lead (Pb), which are effective for improving magnetic characteristics such as coercivity. Any combination of the modifying elements is possible.

The content thereof is extremely small amount in general, and may be about 0.01 to 10 mass % when the whole of the rare earth alloy is 100 mass %, for example. Note that the modifying elements may be originally contained in rare earth alloy particles or otherwise externally introduced due to diffusion treatment and the like.

The inevitable impurities, originated such as from impurities originally contained in the rare earth alloy and mixed during each step, are elements that are difficult to be removed for the cost or technical reason or other reasons. Examples of such inevitable impurities include oxygen (O), nitrogen (N), carbon (C), hydrogen (H), calcium (Ca), sodium (Na), potassium (K), and argon (Ar).

(3) So long as the diffusion material includes diffusion elements (coercivity improving elements), the composition, type, form and the like thereof are not limited. Examples of diffusion elements include diffusion rare earth elements (Rd), such as Dy, Tb, and Ho. It is preferred that the diffusion material comprises single substance or ally thereof. Moreover, the diffusion material to be used in the adhesion step may comprise a single type or plural types. Note that the above contents for modifying elements and inevitable impurities also apply to the diffusion material.

(4) Unless otherwise stated, a numerical range "x to y" as referred to herein includes the lower limit value x and the upper limit value y. Moreover, various lower limits or upper limits as described herein may be freely combined to define a range such as "a to b". Furthermore, any numerical value included in ranges described herein may be used as an upper limit value or a lower limit value to set a newly-created numerical range.

DESCRIPTION OF EMBODIMENTS

Figure 1:
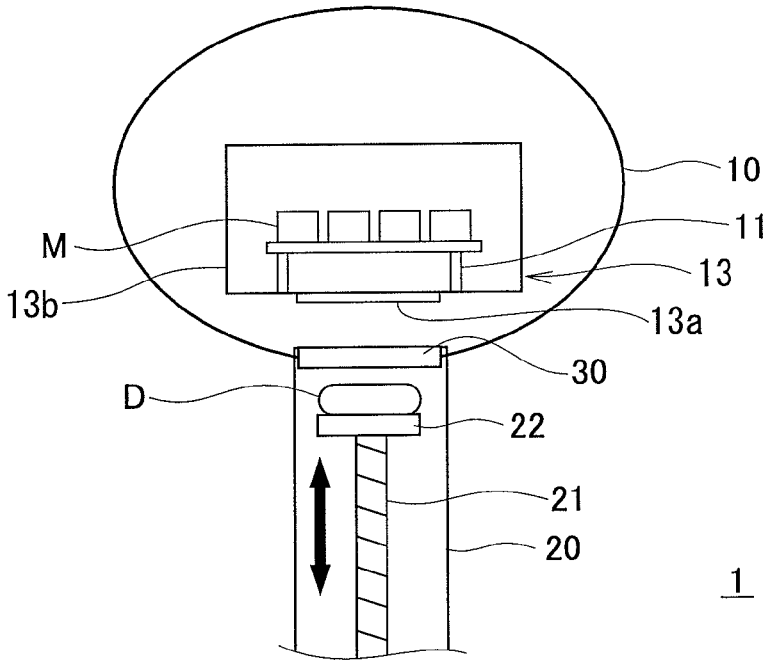
FIG. 1 is a schematic view of a diffusion treatment apparatus.

The present invention will be described more in detail with reference to embodiments of the invention. The contents described herein, including the embodiments below, may be appropriately applied not only to the production process of the present invention but also to a rare earth magnet. One or more features freely selected from the description herein may be added to the above-described features of the present invention. Features regarding a production process, when understood as a product-by-process, may also be features regarding a rare earth magnet. Whether or not which embodiment is the best is different in accordance with objectives, required properties and other factors.

<<Production Process>>

The process for producing a rare earth magnet according to the present invention mainly comprises an adhesion step and an evaporation step, by which diffusion treatment is performed. Each step will hereinafter be described.

(1) The adhesion step is a step that causes a diffusion element to adhere to the surface part (including the case of only surface) of a magnet material comprising a compact or sintered body of rare earth alloy particles obtained such as by crushing a raw material alloy, wherein the diffusion element is capable of diffusing from the surface part to the inner part. Examples of the method of causing the diffusion element to adhere to the surface part of the magnet material include a coating method that applies a diffusion material including the diffusion element to the surface part of the magnet material, and a vapor deposition method that exposes the magnet material to vapor of the diffusion material to vapor deposit the diffusion element on the surface part of the magnet material.

Among them, the vapor deposition method may cause only the diffusion element such as Dy to effectively adhere to or into the magnet material. Therefore, the adhesion step may preferably be a vapor deposition step that causes heated magnet material and heated diffusion material including the diffusion element to come close to each other in vacuum and exposes the magnet material to the vapor of the diffusion element evaporated from the diffusion material thereby to vapor deposit the diffusion element on the surface of the magnet material.

If the adhesion step is the vapor deposition step, then the magnet material and the diffusion material can be independently heated, so that the magnet material temperature (Tm) as the heating temperature of the magnet material and the diffusion material temperature (Td) as the heating temperature of the diffusion material can be separately adjusted to respective preferable temperatures for diffusion treatment. For example, the magnet material may be heated to a temperature at which liquid phases occur at interfaces or grain boundaries of the rare earth alloy particles or the crystals thereof and the diffusion element is thus caused to easily perform grain boundary diffusion, while the diffusion material may be heated to a temperature at which desired vapor of the diffusion element can be obtained. This causes the vapor deposition step to be such that the diffusion element not merely adheres to the surface of the magnet material but also concurrently diffuses into the inner part of the magnet material. One preferred example of the vapor deposition step is such that the heating temperature of the magnet material (Tm) is higher than the heating temperature of the diffusion material (Td).

(2) The evaporation step is a step that heats the magnet material after the adhesion step in vacuum to evaporate at least a portion of the diffusion element having been retained on or in the surface part of the magnet material. During the evaporation step, the heating temperature of the magnet material and the atmosphere may be appropriately adjusted. For example, the heating temperature (magnet material temperature) is preferably a temperature at which the diffusion element is not merely evaporated from the magnet material surface but also facilitated to diffuse into the inner part of the magnet material. Assuming that the adhesion step is the vapor deposition step, the heating temperature during the evaporation step is preferably higher than the heating temperature of the diffusion material (diffusion material temperature) during the vapor deposition step, for example. If, however, the heating temperature during the evaporation step is unduly high, then the diffusion (lattice or volume diffusion) into crystal grains is facilitated to inhibit the diffusion into the inner part of the magnet material, thus being undesirable. In this respect, the heating temperature during the evaporation step may preferably be intermediate between the magnet material temperature and the diffusion material temperature during the vapor deposition step, for example.

In addition, if the adhesion step is the vapor deposition step, then the evaporation step is preferably a step that, subsequently to the vapor deposition step, heats the magnet material in vacuum. Even though the magnet material after the vapor deposition step is cooled to room temperature region and then heated again, the diffusion element is unlikely to evaporate from the surface part of the magnet material. The reason of this is not necessarily sure, but it appears that once the magnet material is cooled after the vapor deposition step, the diffusion element is involved into main phases to be in a stable state.

Further, it is efficient if the evaporation step is performed in vacuum and heated atmosphere created by the vapor deposition step. In this case, the evaporation step may be enough if the diffusion material having been heated by the vapor deposition step is merely decreased in its temperature or separated from the magnet material. In other words, the magnet material may be caused not to be exposed to the vapor of the diffusion element. Therefore, the evaporation step may also be a temperature decrease step that decreases the temperature of the diffusion material or a separation step that separates the diffusion material from the magnet material.

(3) The adhesion step and/or the evaporation step may be combined with at least a part of a sintering step that sinters a compact comprised of rare earth alloy particles. In this case, if the adhesion step is performed within a temperature region where liquid phases are caused in the compact, then the diffusion rate of the diffusion element increases thereby to allow for short-time and efficient diffusion treatment.

In the case where a compact comprised of rare earth alloy particles is sintered herein, the temperature is about 600 to 700 degrees C. at which a liquid phase occurs among a main phase comprised of $R_2TM_{14}B_1$-type crystal (TM: transition metal element), B-rich phase, and R-phase. For example, the liquid phase begins to appear at 665 degrees C. in the case of Nd—Fe—B-based rare earth magnet. Note, however, that if the compact is comprised of rare earth alloy particles having been subjected to hydrotreatment, the liquid phase begins to appear after $RH_2 \rightarrow R+H_2$ occurs at about 750 to 850 degrees C. higher than the above. For example, in the case of a compact comprised of Nd—Fe—B-based rare earth alloy particles having been subjected to hydrotreatment, the liquid phase begins to appear at 800° C. Therefore, the adhesion step and/or the evaporation step may be performed after the magnet material is heated to a temperature equal to or higher than such a temperature at which the liquid phase begins to appear.

Note that such a liquid phase also occurs when the diffusion element and one or more elements in the rare earth alloy particles generate eutectic structure. For example, Dy as the diffusion element and Fe in the rare earth alloy particles begin to generate a liquid phase at a temperature of 890 degrees C. as the eutectic point or more. This causes the amount of the liquid phase in the compact to increase thereby also increasing the diffusion rate of the diffusion element in the compact. Considering the above, if the magnet material is comprised of R-TM-B-based rare earth alloy and the diffusion elements are comprised of one or more rare earth elements, for example, then the magnet material temperature (Tm) may be 700 to 1100 degrees C. and the diffusion material temperature (Td) may be 600 to 1000 degrees C.

(4) The pressure of gas or the degree of vacuum in the vapor deposition step or the evaporation step is appropriately adjusted. For example, if the diffusion rare earth element (Rd) is diffused into the magnet material comprised of R-TM-B-based rare earth alloy, then the pressure of gas (degree of vacuum) in the treatment furnace is preferably 1 Pa or less, more preferably $10^{-1}$ Pa or less, further preferably $10^{-2}$ Pa or less, and most preferably $10^{-3}$ Pa or less. Adjusting this degree of vacuum allows for controlling the vapor amount of the diffusion element caused from the diffusing material and therefore the vapor deposition amount to the magnet material as well as the vapor amount of the diffusion element evaporated from the magnet material.

(5) The treating time for the vapor deposition step or the evaporation step may also be appropriately adjusted in accordance with the amount of the diffusion element to be vapor deposited or evaporated, and it can be drastically reduced compared to the conventional diffusion treatment time. Accordingly, the vapor deposition step or the evaporation step may preferably be during 0.5 to 10 hours and more preferably 1 to 5 hours.

Furthermore, the adhesion step (especially vapor deposition step) and the evaporation step may be each performed once, but may also be repeated plural times in this order. Repeating these steps allows the diffusion element to be effectively increased in its amount thereby efficiently enhancing the coercivity.

<<Magnet Material>>

The magnet material comprises a compact or sintered body of rare earth alloy particles. The rare earth alloy particles may be obtained such as by crushing a rare earth alloy that comprises Rm as one or more types of rare earth elements, B, and remaining transition metal elements (TM: mainly Fe) and inevitable impurities and/or modifying elements.

The rare earth alloy is preferred to be a composition in which an Rm-rich phase is formed effective for improving the coercivity and the sintering ability of the magnet material, rather than being a theoretical composition based on $Rm_2TM_{14}B$. More specifically, it is preferred that the rare earth alloy is an Rm-Tm-B-based alloy comprising 10 to 30 atm % of Rm, 1 to 20 atm % of B, and remaining TM when the whole is 100 atm %.

In particular, high density rare earth magnet having excellent magnetic characteristics is likely to be obtained with 12 to 16 atm % of Rm and 5 to 12 atm % of B. While TM is basically primary remnant, suffice it to say that TM is preferred to be 72 to 83 atm %. Note that carbon (C) may be used as substitute for a part or whole of B, in which case B+C may be adjusted to be 5 to 12 atm %.

The rare earth alloy particles may be, such as, but not limited in regard to the production process therefor and the form thereof, ones obtained by crushing a cast rare earth alloy having a desired composition in a mechanical manner or using hydrogen, thin plate-like cast pieces obtained by rapid solidification using strip cast and the like, ones obtained through hydrogen treatment such as HDDR (Hydrogenation-Decomposition/Dehydrogenation-Recombination), ribbon particles obtained by rapid quenching, or ones obtained by sputtering and the like. Furthermore, the rare earth alloy particles may be amorphous-like.

Although the grain diameter of the rare earth alloy particles is not limited, the average grain diameter (the grain diameter when the accumulated mass comes to be 50%, or median diameter) is preferably 1 to 20 micrometers and more preferably 3 to 10 micrometers. Unduly small average grain diameter may lead to high cost of production, while unduly large diameter may result in deterioration of the density and magnetic characteristics of the rare earth magnet even though the diffusion ability of the diffusion element into the inner part would be excellent. Note that the rare earth alloy particles may also be provided as a mixture of plural types having different compositions and forms (such as particle shape and grain diameter).

<<Application of Rare Earth Magnet>>

The rare earth magnet according to the present invention may be a final product, an intermediate product, or a raw material, and the application and the form thereof are not limited. The rare earth magnet according to the present invention is applicable, for example, to various kinds of electromagnetic equipments such as rotors and stators of electric motors, magnetic recording media such as magnetic disks, linear actuators, linear motors, servomotors, speakers, generators, etc.

EXAMPLES

The present invention will be further specifically described with reference to examples.

<<Diffusion Treatment Apparatus>>

FIG. 1 is a schematic view illustrating a diffusion treatment apparatus (production apparatus for rare earth magnet) 1 used in the diffusion treatment according to the present invention.

The diffusion treatment apparatus 1 comprises: a treatment chamber 10; a preparation chamber 20 connected with the treatment chamber 10; an opening-closing gate (shield means) 30 capable of freely turning on and off the connection between the treatment chamber 10 and the preparation chamber 20; a table (placement means) 11 provided in the treatment chamber 10 for being placed thereon with a magnet material M; an elevator (movement means) 21 causing a diffusion material D to move between the treatment chamber 10 and the preparation chamber 20; a flat heater (diffusion material heating means) 22 attached to the elevator 21 and heating the diffusion material D; and a heating pack 13 as an enclosure which heats the magnet material M and surrounds the magnet material M and the diffusion material D adjacently located thereby to efficiently expose the magnet material M to the vapor caused from the diffusion material D.

Each of six surfaces of the heating pack 13 comprises a reflector and an electric resistance heating-type heater (referred simply to as "heater", hereinafter) attached to the reflector. Bottom surface 13*a* of the heating pack 13 can slide or pivotally move thereby capable of being opened and closed. This bottom surface 13*a* is opened when the diffusion material D elevating from the preparation chamber 20 comes close to the magnet material M. Side surface 13*b* of the heating pack 13 can also slide or pivotally move thereby capable of being opened and closed. Opening this side surface 13*b* allows the inside of the heating pack 13 surrounding the magnet material M to be vacuum atmosphere like in the treatment chamber 10.

The gate 30 enables the treatment chamber 10 and the preparation chamber 20 to be independently adjusted to respective atmospheres. In addition, the magnet material M and the diffusion material D can be independently heated to different temperatures (magnet material temperature and diffusion material temperature) by the heating pack 13 and the flat heater 22, respectively.

Although not shown, it should be appreciated that the treatment chamber 10 is connected thereto with a vacuum pump and a control means separately provided controls integrally the degree of vacuum in the treatment chamber 10, the magnet material temperature, the diffusion material temperature, the up-and-down movement of the elevator 21, and other objectives to be controlled.

In addition, the vacuum exhaust outlet of the treatment chamber 10 is provided with a cold trap which recovers Dy (diffusion element) evaporated from the magnet material M. Furthermore, cooling of the magnet material M is performed by introducing inert gas (Ar) into the treatment chamber 10 when the side surface 13*b* of the heating pack 13 is opened.

Example 1

<Production of Samples>

Rare earth anisotropic sintered magnets (samples) obtained by subjecting magnet materials to diffusion treatment were produced as follows.

(1) Magnet Material

Each magnet material (sintered body) was initially produced as follows. Rare earth alloy of Fe-31.5% Nd-1% B-1% Co-0.2% Cu (unit: mass %) was cast. This rare earth alloy was crushed using hydrogen and thereafter further crushed by jet-mill, and magnet powder having an average grain diameter D50 (median diameter) of 6 micrometers was obtained. Crushing by jet-mill was performed in nitrogen atmosphere.

This magnet powder (aggregate of rare earth alloy particles) was put into the cavity of a forming tool and formed in a magnetic field, and a rectangular solid-like compact of 40×20×15 mm was obtained (forming step). During this forming, a magnetic field of 2 T was applied. This compact was heated under 1050 degrees C. in a vacuum atmosphere of $10^{-3}$ Pa or less during 4 hours, and a sintered body was obtained (sintering step). A magnet material (sample) of 6.5 mm cube obtained by polishing the surface of the sintered body was subjected to the subsequent diffusion treatment. Note that the magnetic characteristics of the magnet material before the diffusion treatment are shown in Table 1 as those of Sample No. C 13.

(2) Diffusion Treatment

The above diffusion treatment apparatus 1 was used to subject each magnet material as a sample to the diffusion treatment as below. The magnet material located in the treatment chamber 10 of the diffusion treatment apparatus 1 was initially heated until its temperature (magnet material temperature: Tm) becomes 900 degrees C. In parallel with the above, the diffusion material located in the preparation chamber 20 was heated until the diffusion material temperature (Td) becomes 770 degrees C. During these operations, the inside of the treatment chamber and the inside of the preparation chamber 20 were set to be vacuum atmosphere of $10^{-4}$ Pa. Note that a Dy single body (metal Dy) was used as the diffusion material to be a vapor source for the diffusion element.

Subsequently, the gate 30 was opened and the diffusion material in the preparation chamber 20 was caused to move into the treatment chamber 10, thus located to come close to the magnet material (locating step). The space between the magnet material and the diffusion material at that time was about 10 mm. The atmospheres in the treatment chamber 10 and the preparation chamber 20 were both controlled to be $10^{-4}$ Pa. In this state, the magnet material and the diffusion material were heated during 2 hours (adhesion step, vapor deposition step).

Figure 2:
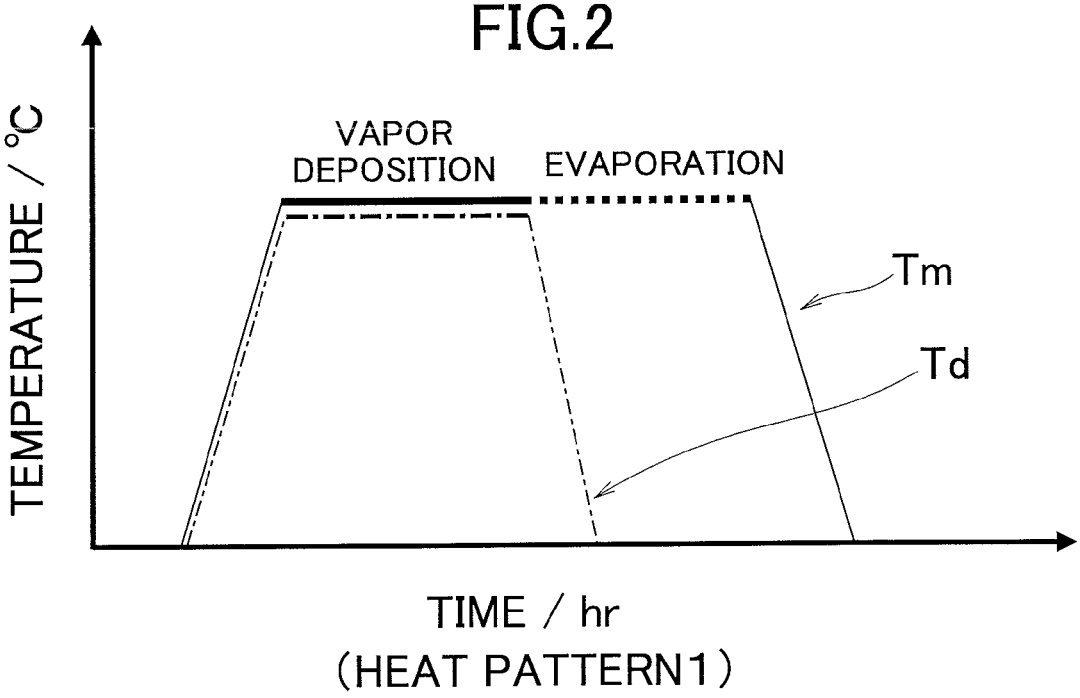
FIG. 2 is an explanatory diagram illustrating heat pattern 1 which represents the temperature changes during the diffusion treatment.

Thereafter, only the diffusion material was stopped being heated and the side surface 13*b* of the heating pack 13 was opened to set the inside of the treatment chamber 10 to be vacuum atmosphere of $10^{-4}$ Pa. The magnet material was continued to be heated still at 900 degrees C. (evaporation step). During this operation, the diffusion material would be caused to move into the preparation chamber 20 and the gate 30 would be closed. FIG. 2 illustrates the temperature history (heat pattern 1) of the magnet material and the diffusion material in the present example.

<Measurement of Samples>

For a sample subjected only to the above vapor deposition step and a sample subjected further to the evaporation step, coercivity was measured using a Pulsed High Field Magnetometer (available from TOEI INDUSTRY CO., LTD). In addition, the amount of Dy diffused into each sample (Dy diffusion amount) was measured using Electron Probe Micro Analyzer (EPMA) and High-Frequency Inductively-Coupled Plasma Mass Analysis (ICP).

Figure 3A:
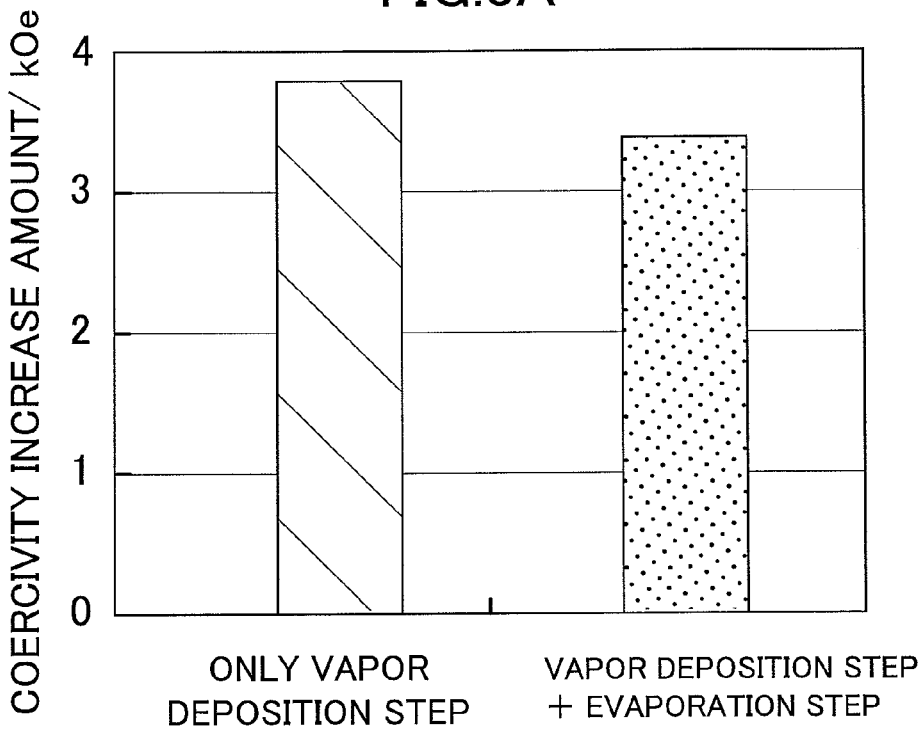
FIG. 3A is a bar graph illustrating a relationship between the presence or absence of the evaporation step and the coercivity increase amount.
Figure 3B:
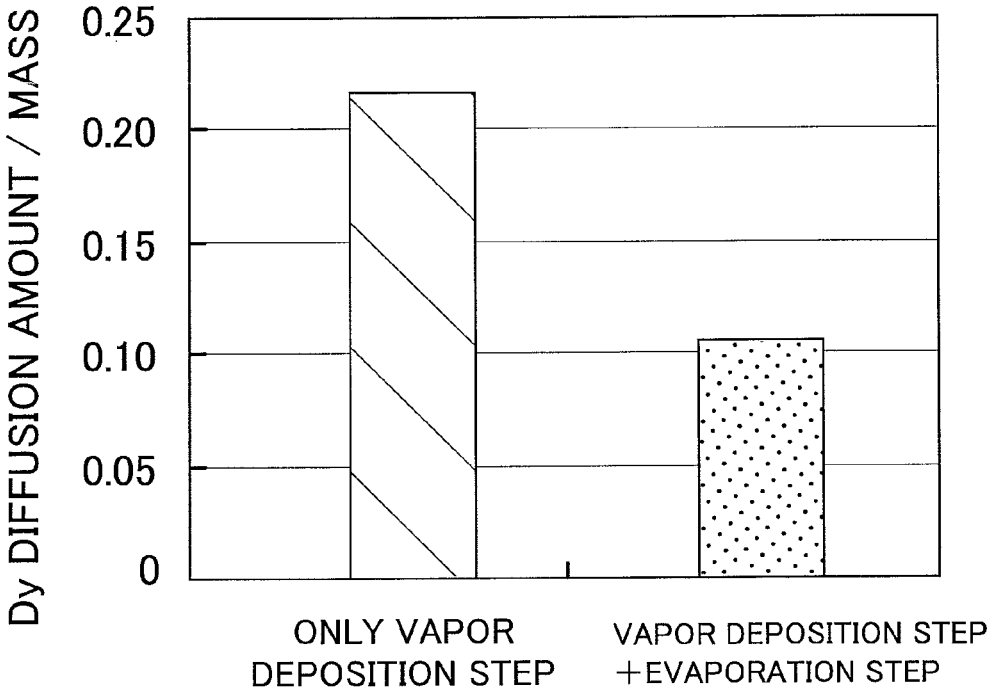
FIG. 3B is a bar graph illustrating a relationship between the presence or absence of the evaporation step and the Dy diffusion amount.

Moreover, coercivity efficiency (delta Ht/d: kOe/mass %), i.e. value obtained by dividing the coercivity difference between before and after the diffusion treatment of each sample (delta Ht: kOe) by the amount of Dy in the sample (d: mass %), was calculated. FIG. 3A is a bar graph illustrating the coercivity increase amount of both samples to the sample before the diffusion treatment (Sample No. C13), FIG. 3*b* is a bar graph illustrating the Dy diffusion amount of both samples introduced by the diffusion treatment, and FIG. 3 illustrates a bar graph illustrating the coercivity efficiency of both samples.

Figure 4A:
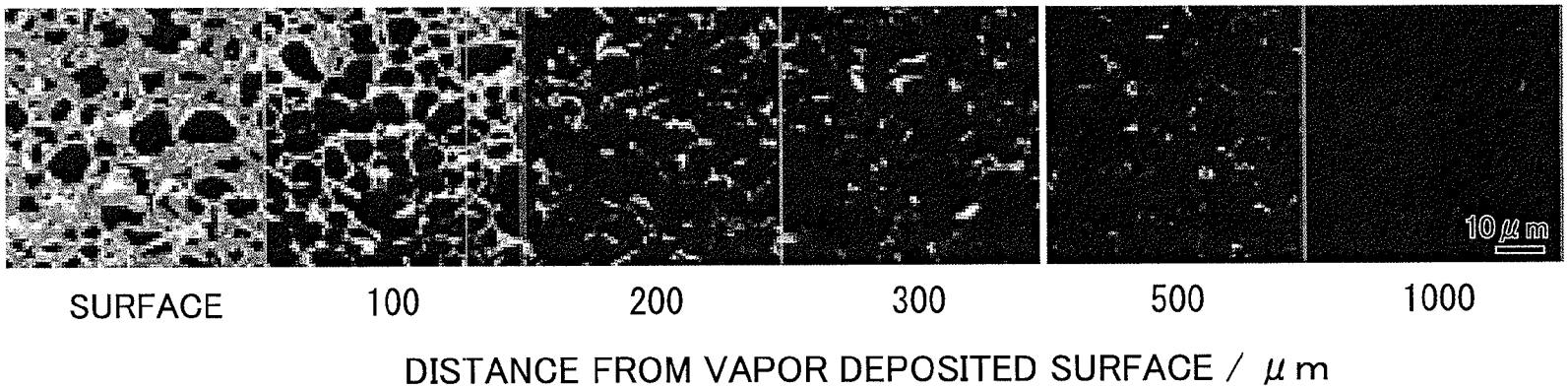
FIG. 4A is EPMA images obtained by observing a rare earth magnet without being subjected to the evaporation step from the surface part to the inner part.
Figure 4B:
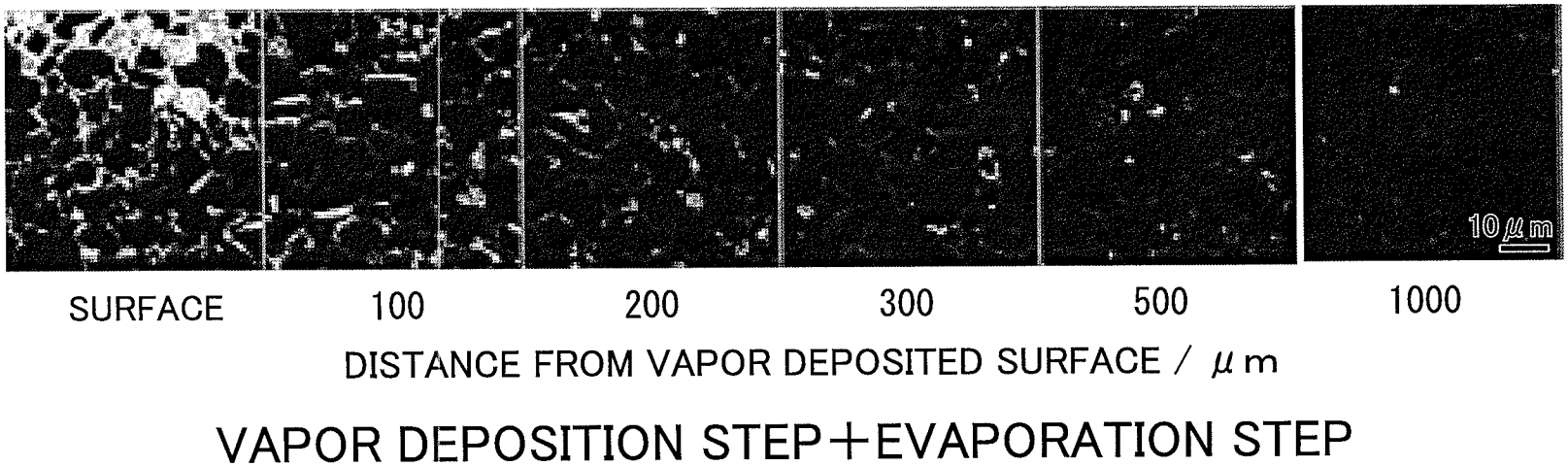
FIG. 4B is EPMA images obtained by observing a rare earth magnet subjected to the evaporation step from the surface part to the inner part.

Furthermore, for the sample subjected only to the vapor deposition step and the sample subjected further to the evaporation step, respective EPMA images (Dy images) were observed from the surface parts deposited thereon with Dy to the inner parts thereof, which are illustrated in FIG. 4A and FIG. 4B, respectively.

Figure 5A:
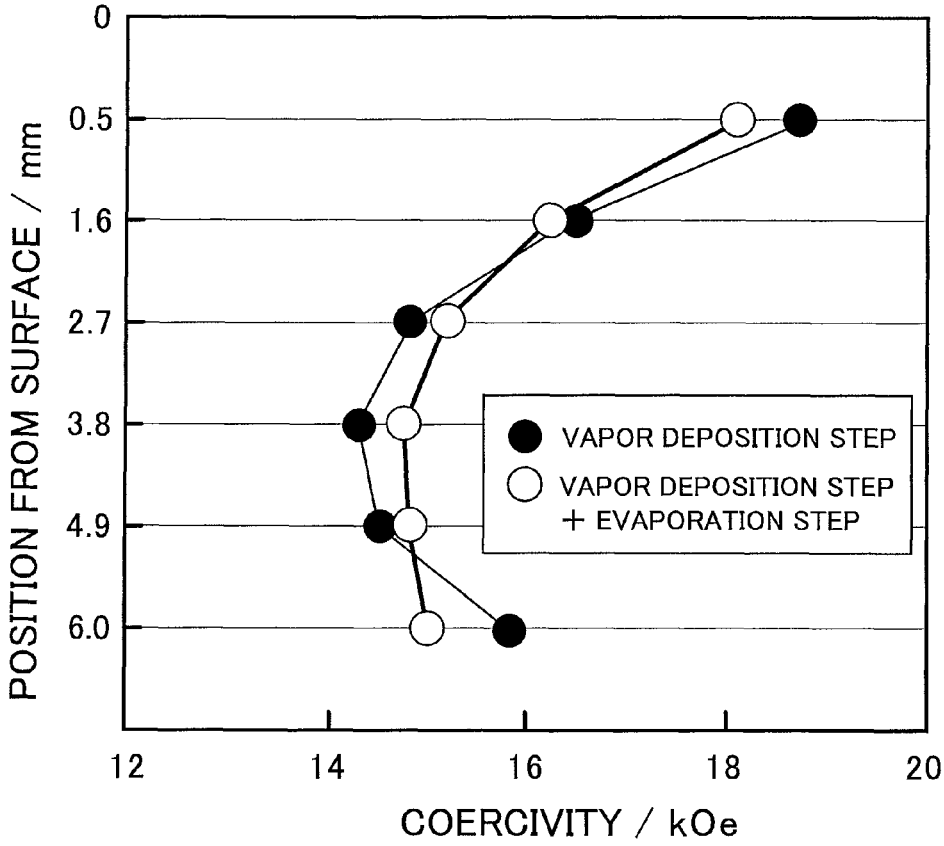
FIG. 5A is a dispersion diagram illustrating a relationship between the presence or absence of the evaporation step and the change in coercivity along from the surface part to the inner part of the rare earth magnet.
Figure 5B:
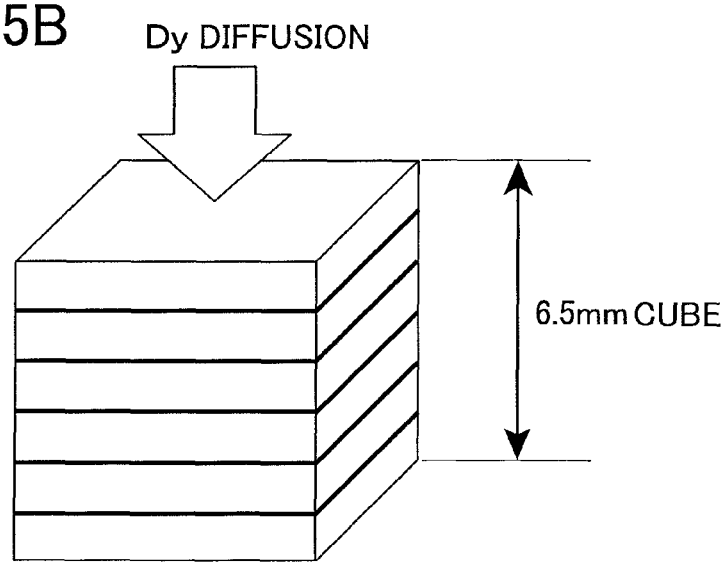
FIG. 5B is a schematic view illustrating a sample for which the coercivity was measured along from the surface part to the inner part.

In addition, as shown in FIG. 5B, each sample of 6.5 mm cube was sliced in turn with a cutting margin of 0.1 mm into six thin-piece samples having a thickness of 1 mm, and the coercivity thereof was measured by the above method. FIG. 5A illustrates the distribution of coercivity directed from the surface part of each sample to the inner part based on the coercivity of each thin-piece sample. Note that FIG. 5A plots the coercivity at the center position in the thickness of each thin-piece sample.

<Evaluation of Samples>

Figure 3C:
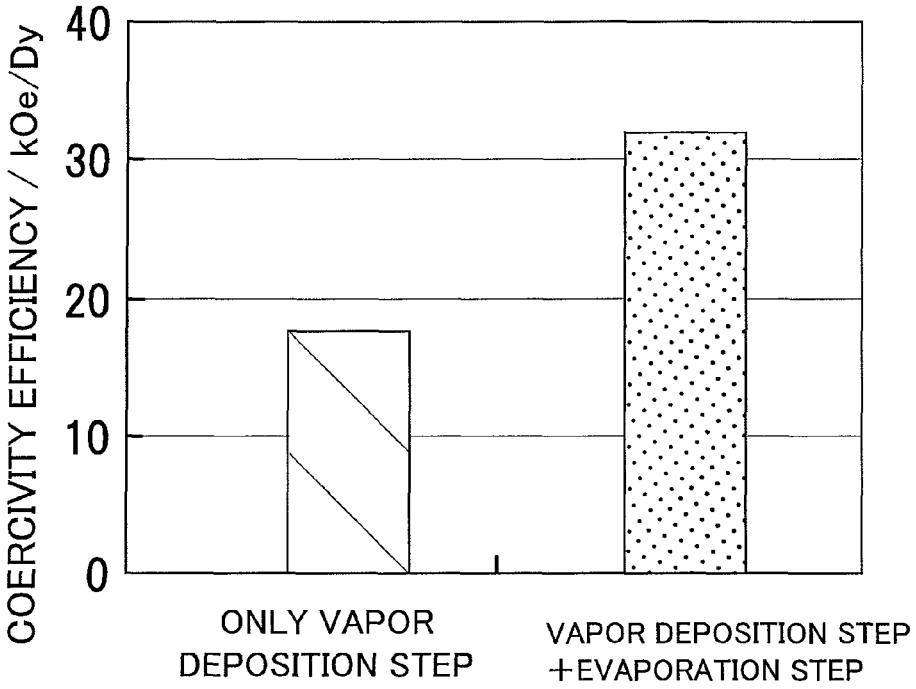
FIG. 3C is a bar graph illustrating a relationship between the presence or absence of the evaporation step and the coercivity efficiency.

As apparent from FIG. 3A and FIG. 3B, the evaporation step significantly decreases the Dy amount in the sample, but the coercivity slightly decreases and the change is small. Therefore, as shown in FIG. 3C, the sample subjected to the evaporation step is drastically improved in the coercivity efficiency about twice that of the sample subjected only to the vapor deposition step.

As apparent from FIG. 4A, the sample subjected only to the vapor deposition step is such that Dy is excessively retained on or in the surface part and the Dy concentration difference is thus large between the surface part and the inner part. On the other hand, as apparent from FIG. 4B, the sample subjected to the evaporation step after the vapor deposition step is such that excessive concentration of Dy is not observed on or in the surface part and it is found that the Dy concentration difference is mitigated and the grain boundary diffusion of Dy progresses further deeply into the inner part.

The above is also apparent from FIG. 5A. That is, even if the Dy amount is reduced due to the evaporation step, any substantive deterioration in coercivity is not observed, and rather, the sample subjected to the evaporation step is improved in coercivity in the center portion (location of 2.7 to 3.8 mm from the surface) of the sample of 6.5 mm cube.

From the present example, it has been found that the evaporation step allows the usage of rare Dy to be significantly suppressed and a rare earth magnet can be obtained which exhibits the coercivity comparable with or larger than that of conventional ones.

Example 2

Figure 6A:
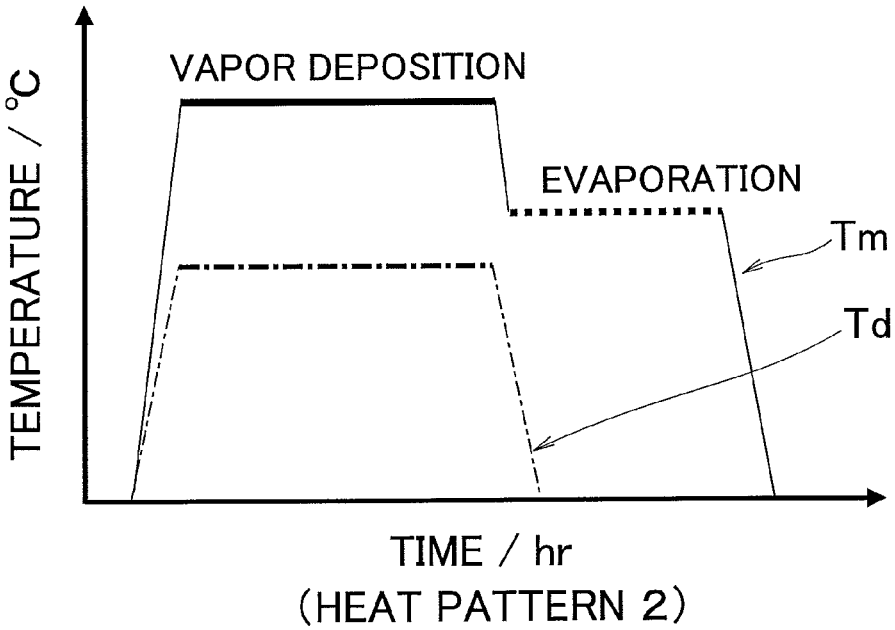
FIG. 6A is an explanatory diagram illustrating heat pattern 2 which represents the temperature changes during the diffusion treatment.
Figure 6B:
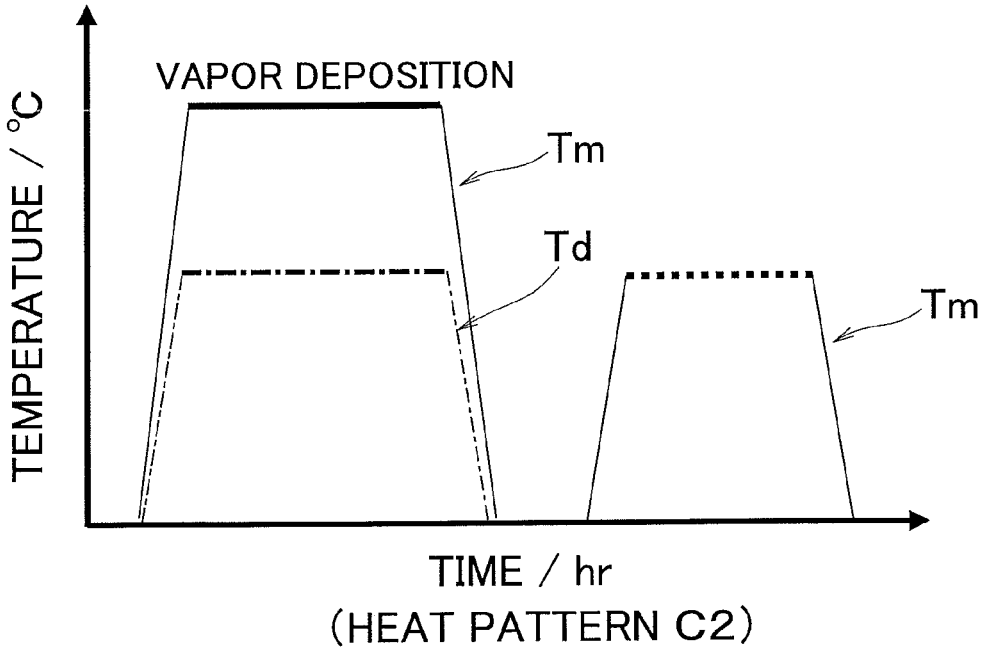
FIG. 6B is an explanatory diagram illustrating another heat pattern C2.

(1) The diffusion treatment was performed using the above-described magnet material along heat pattern 2 shown in FIG. 6A and heat pattern C2 shown in FIG. 6B. The heat pattern 2 is a pattern in which the vapor deposition step with the magnet material temperature (Tm): 1000 degrees C. and the diffusion material temperature (Td): 830 degrees C. (<Tm) was performed during 2 hours and the diffusion material was then removed away from the magnet material, followed by the evaporation step of continuously heating the magnet material at 800 to 900 degrees C. The heat pattern C2 is a pattern in which the same vapor deposition step was performed and the magnet material was then cooled once to room temperature, and thereafter only the magnet material was re-heated at 800 to 900 degrees C.

Figure 7A:
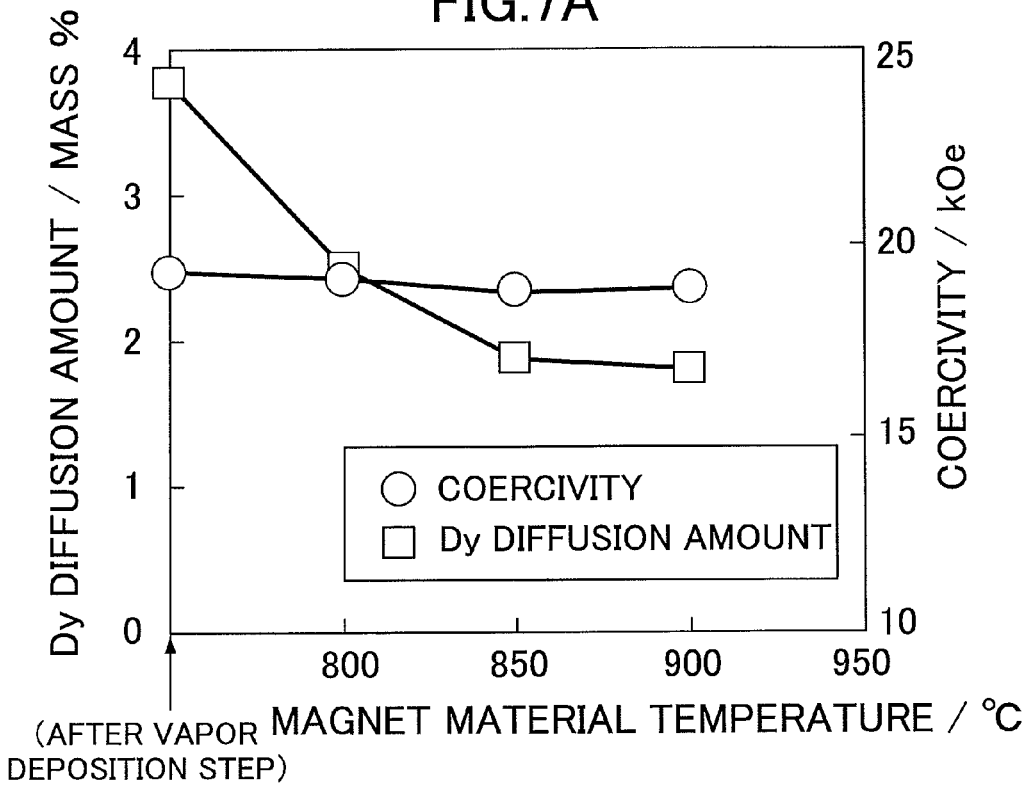
FIG. 7A is a graph illustrating a relationship between the temperature during the evaporation step according to the heat pattern 2 and the Dy diffusion amount and the coercivity.
Figure 7B:
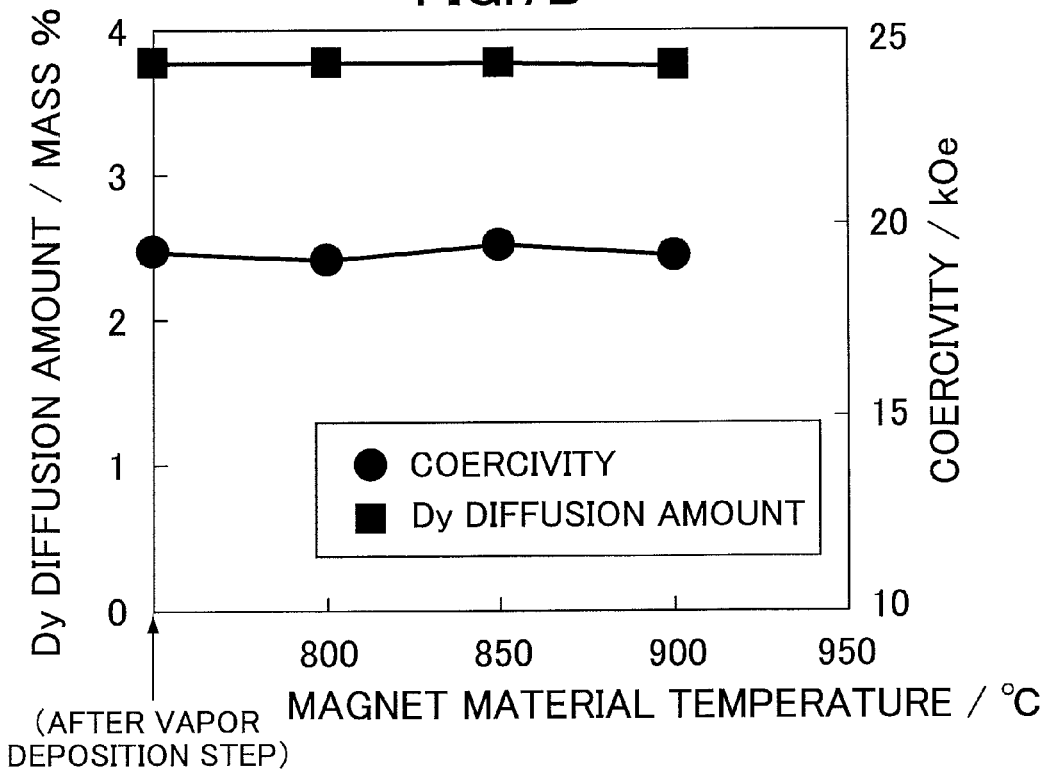
FIG. 7B is a graph illustrating a relationship between the temperature during the evaporation step according to the heat pattern C2 and the Dy diffusion amount and the coercivity.

(2) The Dy diffusion amount and the coercivity of the sample obtained by the heat pattern 2 are shown in FIG. 7A while the Dy diffusion amount and the coercivity of the sample obtained by the heat pattern C2 are shown in FIG. 7B. As apparent from FIG. 7A, in the case of the sample subjected to the evaporation step, the coercivity scarcely changes, but the Dy diffusion amount significantly decreases in accordance with the increase in temperature (magnetic material temperature) during the evaporation step. On the other hand, as apparent from FIG. 7B, in the case of the sample cooled to room temperature in mid-course, both the coercivity and the Dy diffusion amount scarcely change. It appears that this is because cooling the sample to room temperature after the vapor deposition step causes Dy present at least on or in the surface part of the magnet material to be incorporated in the main phase particles of the rare earth magnet thereafter to become a stable state due to the re-heating with such an extent that Dy is unlikely to evaporate. In any event, the present example shows that the evaporation step is preferred to be performed subsequently to the vapor deposition step (while heating the magnet material in vacuum) in order to obtain a high coercivity while suppressing the amount of Dy to be used.

Example 3

Figure 8A:
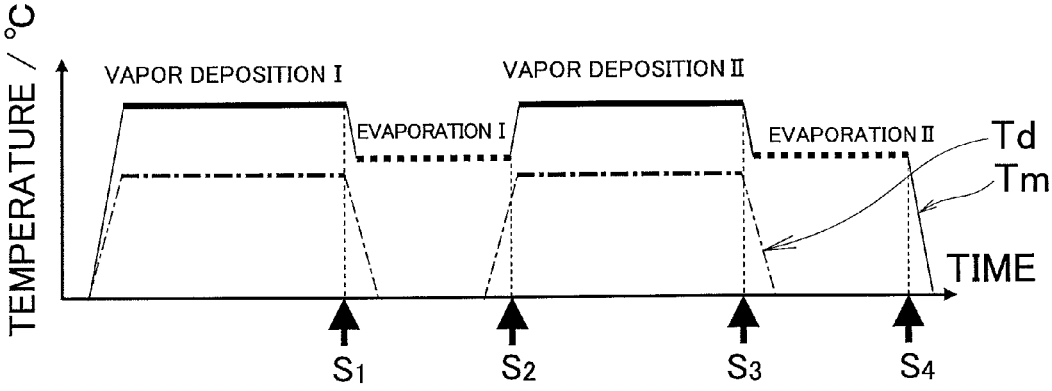
FIG. 8A is an explanatory diagram illustrating heat pattern 3 which represents the temperature changes during the diffusion treatment.

(1) The diffusion treatment was performed using the above-described magnet material along heat pattern 3 shown in FIG. 8A. The heat pattern 3 is a pattern comprising: a first diffusion treatment in which vapor deposition step I with the magnet material temperature (Tm): 950 degrees C. and the diffusion material temperature (Td): 770 degrees C. (<Tm) was performed during 2 hours and evaporation step I was performed to continuously heat the magnet material at 900 degrees C. while cooling the diffusion material to room temperature region; and a second diffusion treatment in which vapor deposition step II like the vapor deposition step I and evaporation step II like the evaporation step I were once repeated.

Figure 8B:
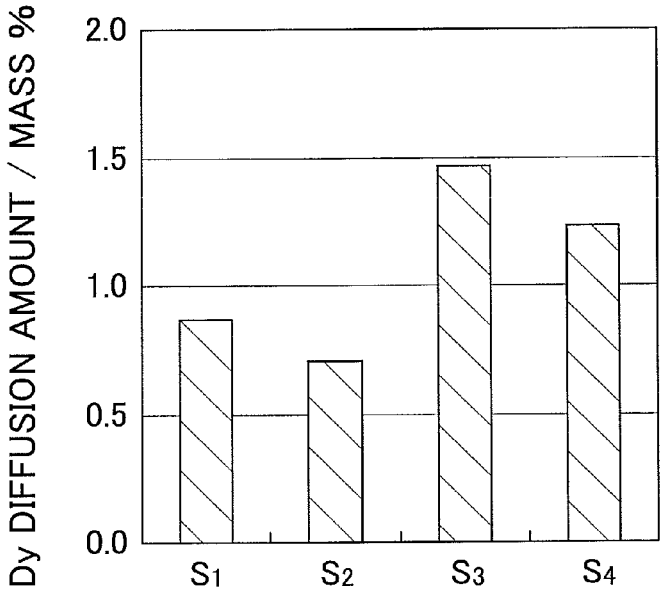
FIG. 8B is a bar graph illustrating the Dy diffusion amount at each time point of the heat pattern 3.
Figure 8C:
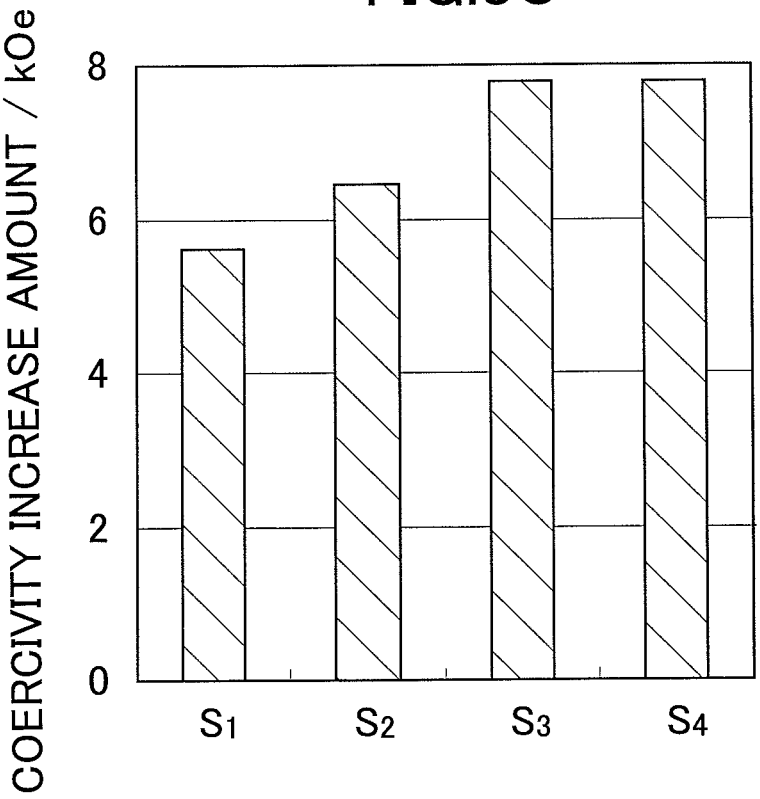
FIG. 8C is a bar graph illustrating the coercivity increase amount at each time point of the heat pattern 3.

(2) The Dy diffusion amount in the sample at each stage of the heat pattern 3 is shown in FIG. 8B, and the coercivity increase amount to the sample before the diffusion treatment at each stage is shown in FIG. 8C. Note that stages S1, S2, S3, and S4 represent the time point when the vapor deposition step I has been completed, the time point when the evaporation step I has been completed, the time point when the vapor deposition step II has been completed, and the time point when the evaporation step II has been completed, respectively.

First, as apparent from FIG. 8B, the evaporation step I or the evaporation step II causes the Dy diffusion amount in the sample to decrease compared with that after the vapor deposition step I or the vapor deposition step II, respectively. Note, however, that the repetition of the vapor deposition step and the evaporation step causes the Dy to significantly increase.

Next, as apparent from FIG. 8C, even if the evaporation step I or the evaporation step II causes the Dy diffusion amount to decrease, the coercivity increases rather than decreases. In addition, as the repetition of the vapor deposition step and the evaporation step causes the Dy to increase, the coercivity increases accordingly. Therefore, the present example shows that the repetition of the diffusion treatment comprising the vapor deposition step and the evaporation step allows the coercivity to further be enhanced while suppressing the amount of Dy to be used.

Example 4

(1) Samples subjected to the heat treatment with various heat patterns shown in Table 1 were prepared (Samples No. 1 to 4 and Samples No. C1 to C10). Note that Samples No. C1 to C10 were subjected to the diffusion treatment with heat pattern C0 shown in FIG. 9B or heat pattern C3 as shown in FIG. 9C. Note also that the heat pattern C0 is a conventional heat pattern in which the magnet material and the diffusion material are heated under the same condition. Note further that Sample No. C10 was obtained by diffusing Dy of 0.6 mass % by the diffusion treatment to a magnet material comprising rare earth alloy particles that had preliminarily contained 3.5 mass % of Dy by dissolution method.

In addition, samples were also prepared, comprising rare earth alloy particles contained therein with Dy by dissolution method but without being subjected to any diffusion treatment (Sample No. C11 and Sample No. C12). Sample No. C13 is the above-described magnet material before being subjected to the diffusion treatment. Magnetic characteristics (coercivity) of these samples were obtained like the above-described each sample, and are also listed in Table 1.

Figure 9A:
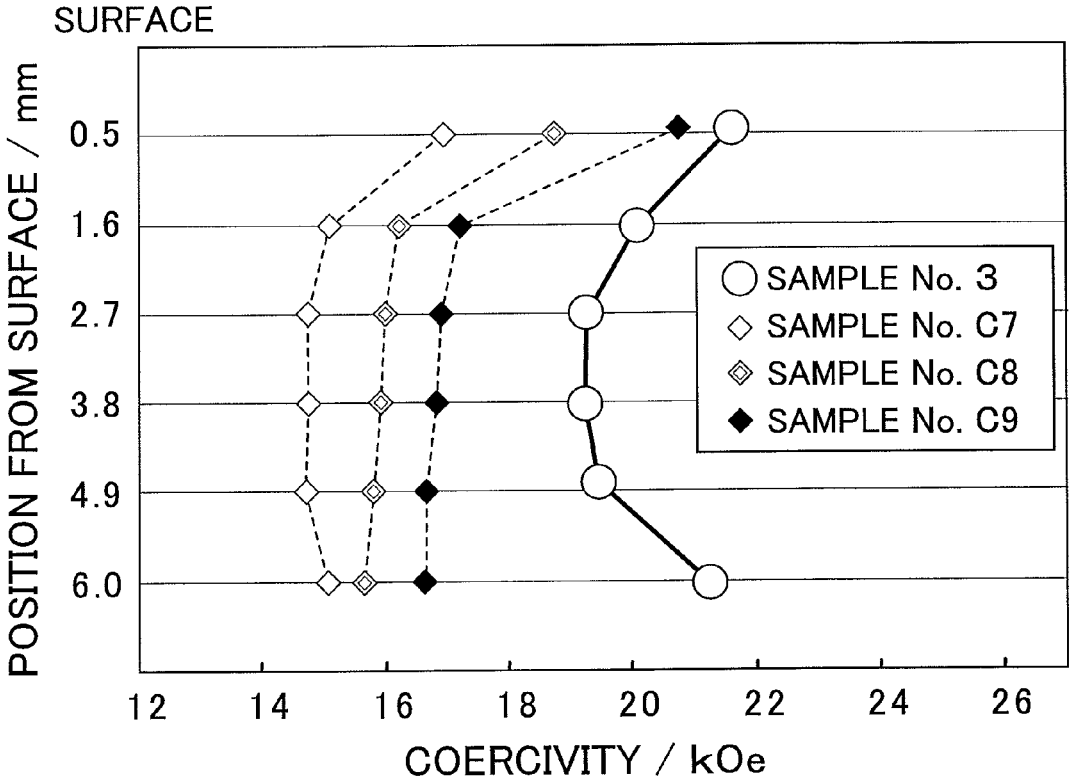
FIG. 9A is a dispersion diagram illustrating the changes in coercivity along from the surface parts to the inner parts of various rare earth magnets.
Figure 9B:
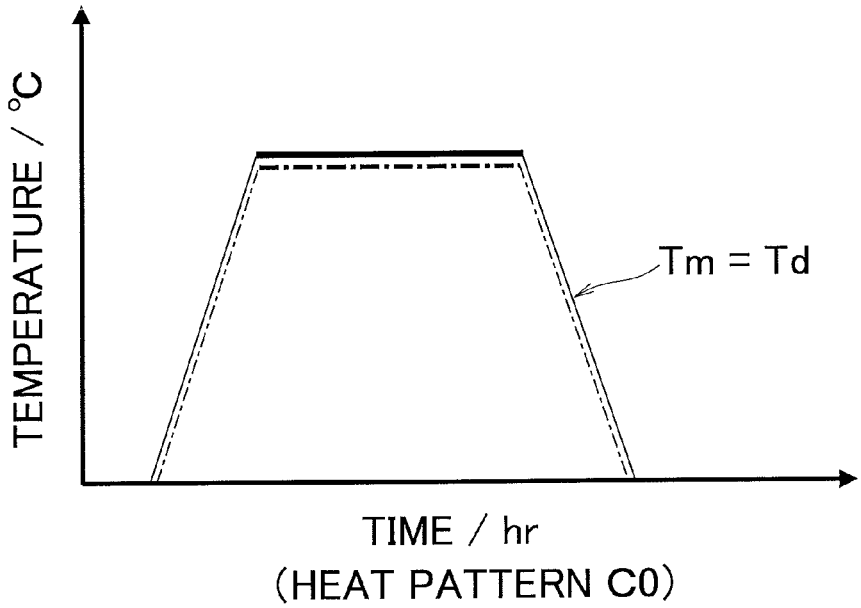
FIG. 9B is an explanatory diagram illustrating conventional heat pattern C0.
Figure 9C:
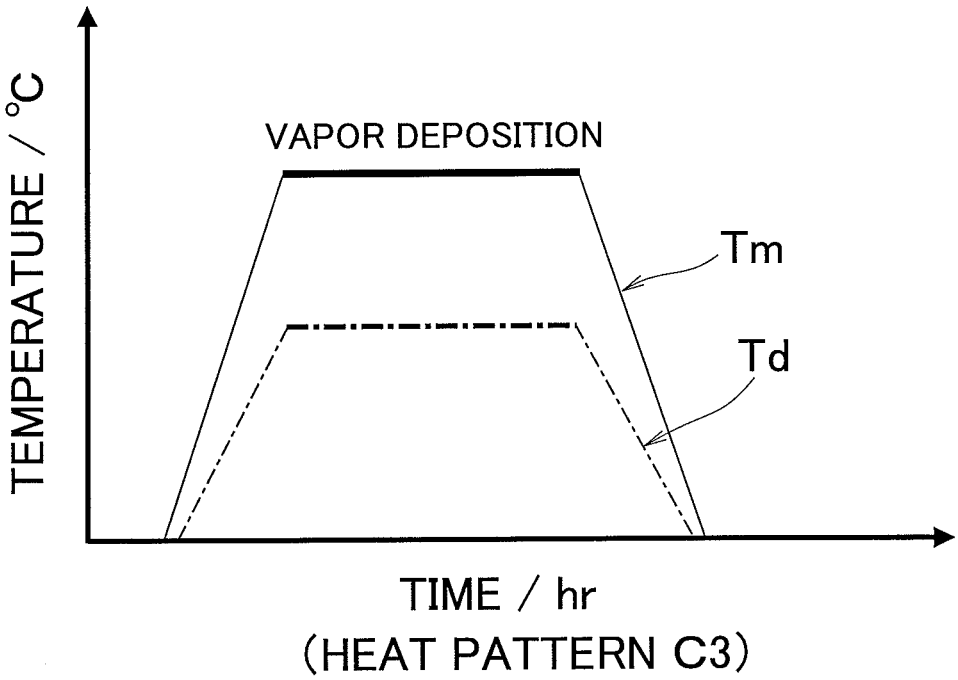
FIG. 9C is an explanatory diagram illustrating another heat pattern C3.

(2) FIG. 9A illustrates the distribution of coercivity directed from the surface part to the inner part for each of Sample No. 3 obtained by heat pattern 3 and Samples No. C7 to C9 obtained by heat pattern C0. Note that the measurement and indication of coercivity at each position are like those in the cases shown in FIG. 5A and FIG. 5B.

As apparent from FIG. 9A, it is found that, by performing not only the vapor deposition step but also the evaporation step and repeating them, the coercivity significantly increases in the surface part as well as in the inner part even if the Dy diffusion amount is about 1.2 mass %.

Figure 10:
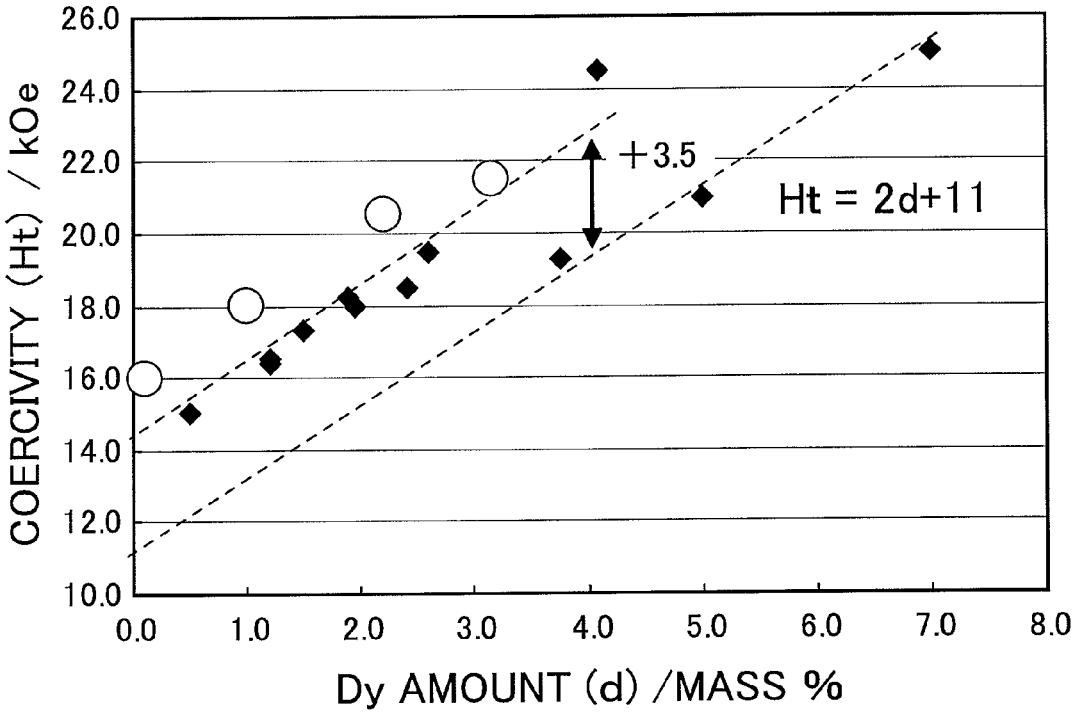
FIG. 10 is a dispersion diagram illustrating the relationship between the Dy amount (d: mass %) and the coercivity (Ht: kOe) investigated for various rare earth magnets.
Figure 11:
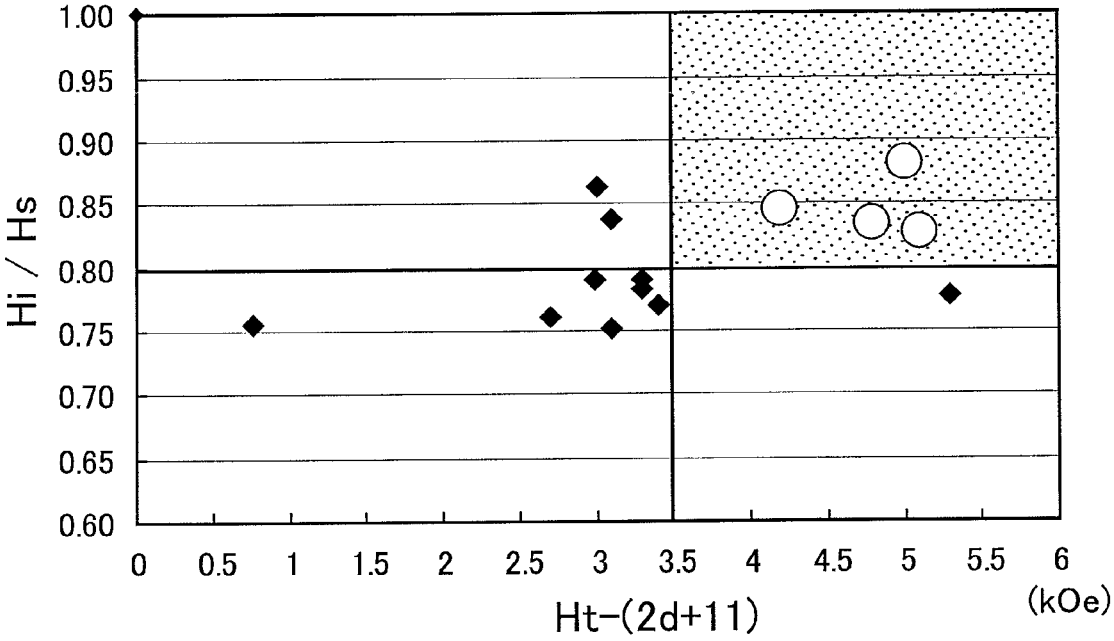
FIG. 11 is a dispersion diagram illustrating characteristics regarding the coercivity of those rare earth magnets.

(3) FIG. 10 illustrates a correlation between the Dy diffusion amount (d: mass %) and the coercivity of the whole of the rare earth magnet (Ht: kOe) regarding each sample listed in Table 1. In addition, FIG. 11 illustrates a correlation between Ht−(2d+11) and Hi/Hs regarding these examples. Note that Hi (kOe) represents the coercivity of the third thin-piece sample (location of 3.3 to 4.3 mm from the surface: corresponding to 51% to 66% the total height (6.5 mm)) cut out from the sample of 6.5 mm cube. Note also that Hs (kOe) represents the coercivity of the first thin-piece sample (location of 0 to 1 mm from the surface: corresponding to 0% to 15% the total height) cut out from the sample of 6.5 mm cube.

First, as apparent from FIG. 10, samples in which Dy is contained in the raw material (rare earth alloy particles) by dissolution method give their plots substantially on the straight line of Ht−(2d+11)=0. In contrast, samples subjected to the evaporation step in addition to the vapor deposition step as in the present invention have the coercivity Ht higher than the straight line by 3.5 kOe or more. In other words, it is found that those plots exist in a region of Ht−(2d+11)≥3.5.

Next, as apparent from FIG. 11, the samples subjected to the evaporation step in addition to the vapor deposition step are such that Ht−(2d+11) is 3.5 or more and also the ratio of coercivity between the inner part and the surface part Hi/Hs is 0.8 or more. In particular, Samples No. 1 to 4 fall within a region defined by 4≤Ht−(2d+11)≤5.5 and 0.8≤Hi/Hs≤0.9. It is to be noted that this region is a region which could not have been achieved by Samples No. C1 to C10 or conventional rare earth magnets and which has been developed by the rare earth magnet according to the present invention at first time.

Reference Signs List

1 . . . diffusion treatment apparatus (production apparatus for rare earth magnet)
10 . . . treatment chamber
20 . . . preparation chamber
M . . . magnet material
D . . . diffusion material

The invention claimed is:

1. A process for producing a rare earth magnet, the process comprising:

an adhesion step of causing a diffusion element capable of diffusing inwardly to adhere to a surface part of a magnet material comprising a compact or sintered body of rare earth alloy particles; and an evaporation step of heating the magnet material in vacuum to evaporate at least a portion of the diffusion element having been retained on or in the surface part of the magnet material, wherein:

the adhesion step is a vapor deposition step that causes heated magnet material and heated diffusion material including the diffusion element to come close to each other in vacuum and exposes the magnet material to a vapor of the diffusion element evaporated from the diffusion material thereby to vapor deposit the diffusion element on the surface of the magnet material;

the evaporation step is a step that, subsequently to the vapor deposition step, heats the magnet material in vacuum without cooling the magnet material to room temperature region; and the adhesion step and the evaporation step are repeated in this order.

* * * * *

TABLE 1

| | Dispersion treatment | | | | | | | Magnetic characteristics | | | | | |
|---|---|---|---|---|---|---|---|---|---|---|---|---|---|
| | Vapor deposition step | | | Evaporation step | | | | Coercivity | | | | | Ratio of coercivity between surface part and inner part Hi/Hs |
| Sample No. | Magnet material temperature Tm (° C.) | Dispersion material temperature Td (° C.) | Time (Hr) | Magnet material temperature Tm (° C.) | Time (Hr) | Heat pattern | Total Dy amount (mass %) | Whole Ht (kOe) | Surface part Hs (kOe) | Inner part Hi (kOe) | Coercivity efficiency (ΔHt/ΔDy) (kOe/mass %) | Improvement of coercivity Ht − (2 d + 11) (kOe) | |
| 1 | 900 | 770 | 2 | 900 | 2 | 1 | 0.1 | 16 | 18 | 15 | 32 | 4.8 | 0.83 |
| 2 | 1000 | 830 | | 950 | 1 | 3 | 1 | 18 | 21 | 18.5 | 5.5 | 5 | 0.88 |
| 3 | 950 | 770 | | 900 | 2 | 3 | 1.2 | 20.5 | 23 | 19 | 6.7 | 7.1 | 0.83 |
| 4 | 1000 | 830 | | 850 | 1 | 2 | 3.2 | 21.5 | 22.5 | 19 | 2.8 | 4.2 | 0.84 |
| C1 | 1000 | 830 | 2 | — | | C3 | 3.8 | 19.3 | 24.5 | 18.5 | 1.9 | 0.8 | 0.76 |
| C2 | 950 | | | | | | 2.6 | 19.5 | 24 | 18.8 | 3.2 | 3.3 | 0.78 |
| C3 | 900 | | | | | | 2 | 18 | 22.5 | 16.9 | 2.8 | 3.1 | 0.75 |
| C4 | 1000 | 770 | 2 | | | | 2.4 | 18.5 | 23 | 17.5 | 2.5 | 2.7 | 0.76 |
| C5 | 950 | | 2 | | | | 1.9 | 18.2 | 22.1 | 17 | 3.0 | 3.4 | 0.77 |
| C6 | 900 | | 4 | | | | 1.2 | 16.4 | 19 | 15 | 3.3 | 3 | 0.79 |
| C7 | | 830 | 32 | — | | C0 | 0.5 | 15 | 16.8 | 14.5 | 8.0 | 3 | 0.86 |
| C8 | | | 64 | | | | 1.2 | 16.5 | 18.5 | 15.5 | 4.6 | 3.1 | 0.84 |
| C9 | | | 128 | | | | 1.5 | 17.3 | 20.9 | 16.5 | 4.2 | 3.3 | 0.79 |
| C10 | 900 | 830 | 2 | — | | C3 | 4.1 | 24.5 | 27 | 21 | 8.3 | 5.3 | 0.78 |
| C11 | | | — | | | | 5 | 21 | 21 | 21 | 1.8 | 0 | 1 |
| C12 | | | | | | | 7 | 25 | 25 | 25 | 1.8 | 0 | 1 |
| C13 | | | | | | | 0 | 12 | 12 | 12 | — | 0 | 1 |